US005527097A

United States Patent [19]

Martin

[11] Patent Number: 5,527,097

[45] Date of Patent: Jun. 18, 1996

[54] EDGING MEMBER AND SEATING DEVICE THEREFORE

[75] Inventor: Leo Martin, Coconut Grove, Fla.

[73] Assignee: Miami Metal Products, Inc., Miami, Fla.

[21] Appl. No.: 460,249

[22] Filed: Jun. 2, 1995

[51] Int. Cl.[6] ..... A47C 15/00

[52] U.S. Cl. ..... 297/463.1

[58] Field of Search ..... 297/463.1, 218.3, 297/218.5, 440.11, 452.18, 452.38, 452.59, 452.60, 452.58, 218.1; 248/345.1; 312/137, 140.4; 5/100

[56] References Cited

U.S. PATENT DOCUMENTS

| | | | |
|---|---|---|---|
| 3,281,185 | 10/1966 | Albinson et al. | 297/452.38 X |
| 4,106,739 | 8/1978 | Gasser | 248/345.1 |
| 4,370,373 | 1/1983 | Janicz | 248/345.1 X |
| 4,582,739 | 4/1986 | Givens | 248/345.1 X |
| 4,810,550 | 3/1989 | Gasser | 248/345.1 X |
| 4,848,843 | 7/1989 | Gibbs | 297/226 X |
| 5,248,186 | 9/1993 | Steinfeld et al. | 248/345.1 X |

FOREIGN PATENT DOCUMENTS

| | | | |
|---|---|---|---|
| 3212568 | 10/1983 | Germany | 297/218.2 |

*Primary Examiner*—Milton Nelson, Jr.

[57] ABSTRACT

An edging member for chairs comprises a continuous resilient bumper having a chamber defined by at least one chamber wall. The member is secured to a chair frame by a pair of spaced flanges which fit about the frame and are secured thereto by staples or the like. The edge member is formed of a high density, resilient, resin such as polyvinyl chlorida or polyurethane.

17 Claims, 2 Drawing Sheets

EDGING MEMBER AND SEATING DEVICE THEREFORE

FIELD OF THE INVENTION

The present invention relates to a decorative and protective edging member for chairs and like seating devices. More particularly, the edging can be wrapped about the frame of the chair while substantially retaining its preformed profile.

BACKGROUND OF THE INVENTION

A number of prior art devices for this field have been disclosed and taught. For reference, one is directed to U.S. Pat. Nos. 1,936,113; 3,393,933; 3,647,260; 3,836,043; 4,003,180 and 4,106,739. All of these references disclose a resilient bumper of one means another. With specific regard to the U.S. Pat. No. 4,106,739, a continuous hollow edge member is taught. The disadvantage of this device is one of aesthetics; when the device is applied to the curved edges of a seating device frame, the edging member loses its preformed shape and gives the appearance of collapsing. None of the prior art teaches an edging member capable of retaining its preformed shape when said edge member is applied to the curved frame of a chair, for example, its seat back, or other seating device frames.

SUMMARY OF THE INVENTION

An edging member for chairs comprises a continuous resilient bumper having a chamber defined by at least one chamber wall. Means for securing said member to a chair frame comprises a pair of spaced flanges which fit about the frame and are secured thereto by staples or the like. The edge member is formed of a high density, resilient, resin such as polyvinyl chloride or polyurethane.

BRIEF DESCRIPTION OF THE DRAWINGS

The features embodying the present invention are illustrated in the accompanying drawing, forming a part of this application, in which.

DETAILED DESCRIPTION OF A PREFERRED EMBODIMENT

Figure 1:
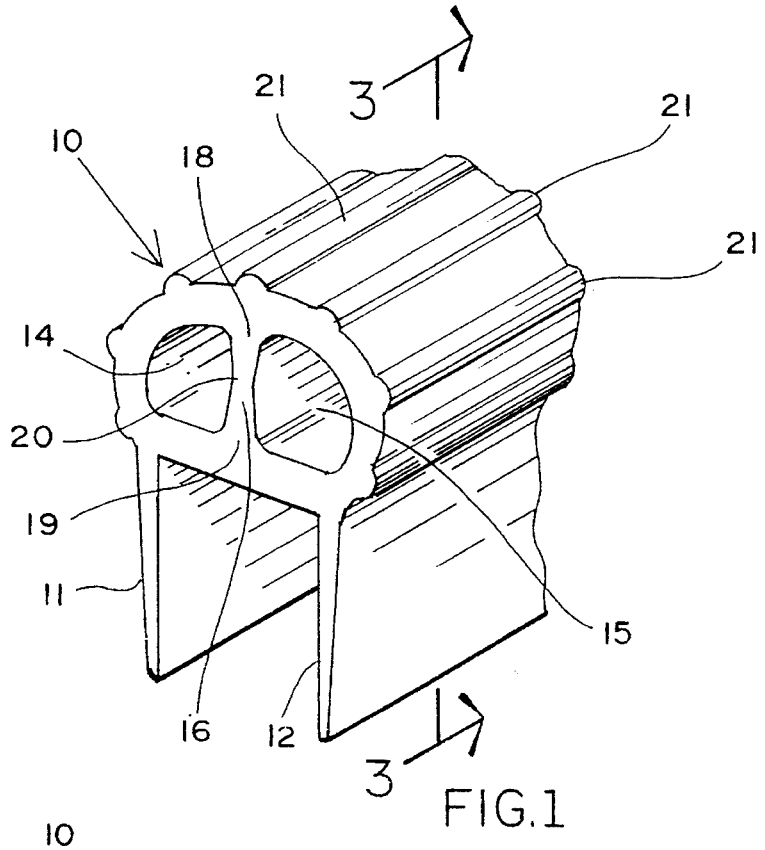
FIG. 1 is a fragmented perspective view of the present invention.

A detailed description of the present invention is shown in FIG. 1. Therein, edge member 10 is comprised of a continuous resilient, high density resin, for example, polyvinyl chloride or polyurethane. Edge member 10 has a pair of spaced flanges 11 and 12, respectively, disposed on opposite sides thereof and depending therefrom. The edge member 10 is substantially annular in shape and has two cavities 14 and 15, respectively, defined by a vertically disposed, interior, stiffening rib, central chamber wall member 16. Chamber wall 16 is contiguous with respect to the edge member 10. Chamber wall 16 comprises a radius such that the wall top

18 and wall bottom 19 are thicker in resinous makeup than the wall center 20.

The edge member 10 is shown with a reeded finish as depicted by a number of bosses 21, however, the finish may be smooth or may incorporate other decorative looks to the taste of the user.

Figure 2:
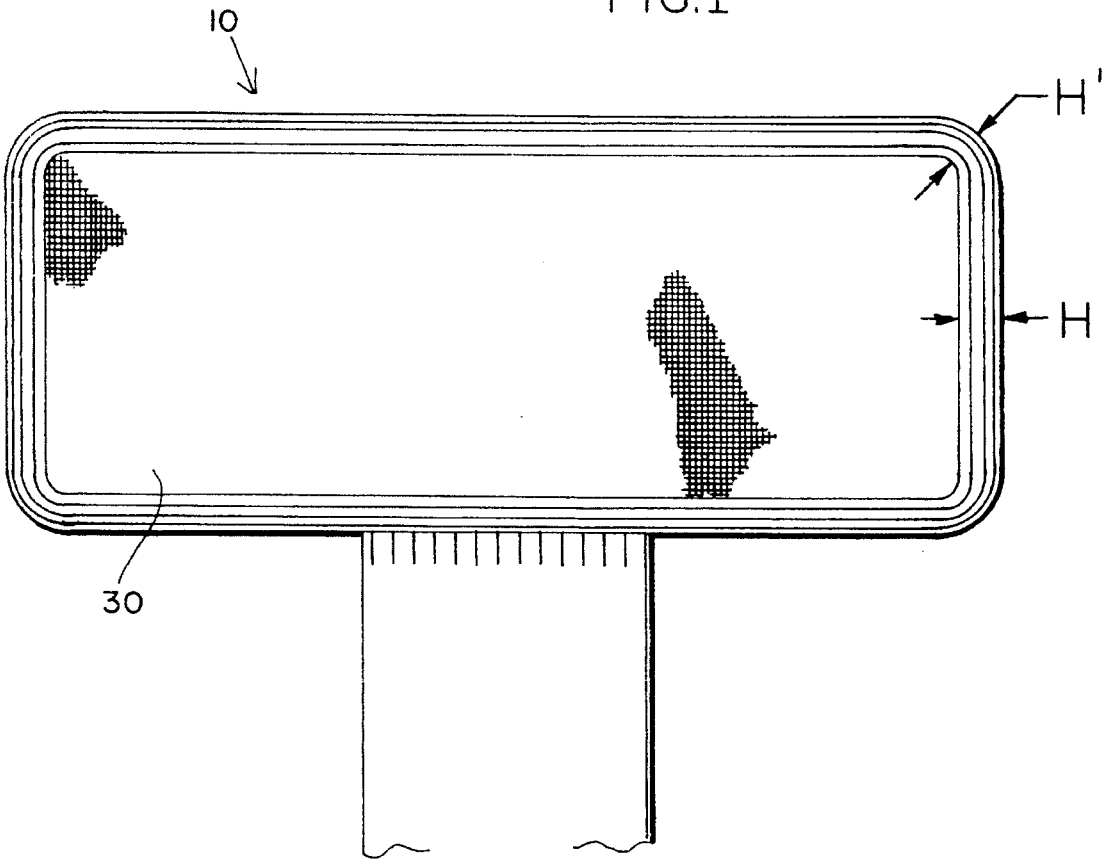
FIG. 2 is a fragment front view of the seat back of a chair with the present invention applied thereon.

FIG. 2 shows the edge member 10 on the seat back 30 of a chair (shown fragmentally). The chamber wall 16 supports the edge member 10 when edge member 10 conforms to the contour of seat back 30, such that the edge member 10 does not deflect substantially when placed on the curves of seat back 30. In this regard, the height H of edge member 10 taken along a flat portion of seat back 30 is substantially similiar to the height H' of edge member 10 taken at a curved section of the seat back 30.

Figure 3:
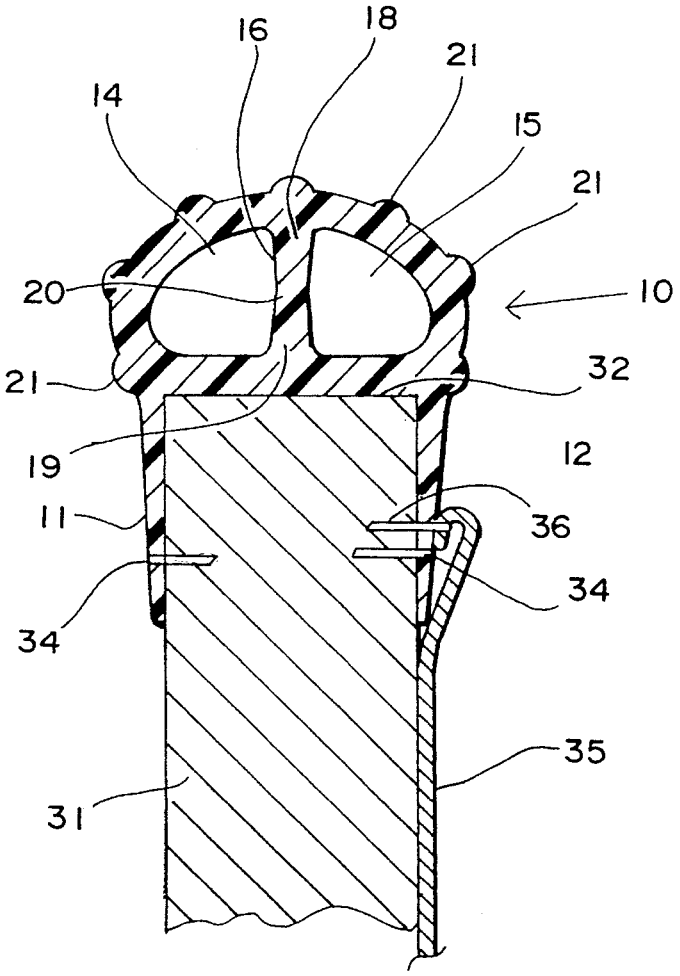
FIG. 3 is a cross section fragmented view of the present invention as applied to the frame of a chair along line 3—3 of FIG. 1.

A cross section of the edge member 10 on seat back 30 is illustrated in FIG. 3. Therein, flanges 11 and 12 fit about the frame 31 of seat back 30. Flanges 11 and 12 depend from edge member 10 and are spaced apart by beam 32 of edge member 10. Beam 32 is generally flat and forms a flush fit to conform to the shape of seat back frame 31. As shown, seat back frame 31 is flat and thus, beam 32 is generally flat.

Edge member 10 is secured to frame 31 by staples 34 attached through flanges 11 and 12. Thereafter, upholstery 35 is added to finish the seat back 30 or other seating device. The top of the upholstery 35 is secured by staples 36 to the flange 12 (as shown), and then looped over the staple 36 so as to hide it. The bottom of the upholstery 35 is then secured to the bottom of the seat back 30 or other seating device.

Figure 4:
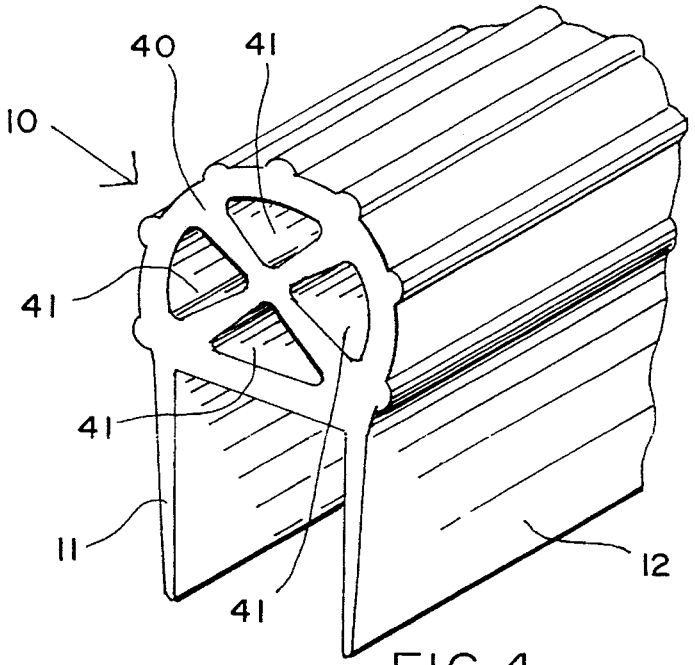
FIG. 4 is a perspective view of an alternative embodiment of the present invention.

Referring to FIG. 4, an alternative embodiment is depicted where chamber wall 40 divides the hollow interior of the edge member 10 into four cavities 41. A plurality of cavities or chamber walls may be designed depending upon the material chosen for the edge member 10 and the degree of flexibility sought in the member 10. However, the preferred embodiment does comprise at least one chamber wall and two cavities as disclosed and taught above.

It is intended that the description of the preferred embodiment of this invention is illustrative only. Other embodiments of the invention that are within the scope and concept of this invention are herein included within this application.

What is claimed is:

1. A resilient edging member for a seating device comprising an annular shape defined by an interior chamber wall having a wall top and a wall bottom disposed vertically therefrom, said top and bottom extending to said annular shape forming a pair of hollow cavities, and having a plurality of flanges depending from said annular shape where said flanges are spaced apart by a beam wherein, said beam is generally perpendicular to said flanges.

2. In the edging member of claim 1, said chamber wall is contiguous with said annular shape.

3. In the edging member of claim 1, said chamber wall further comprises a top section, a bottom section, and a center section such that said top section and said bottom section are thicker in makeup then said center section.

4. In the edging member of claim 1, said flanges numbering two.

5. In the edging member of claim 1, said member being manufactured of a high density resin.

6. A resilient edging member for a seating device comprising an annular shape defined by at least one interior chamber wall having a wall top and a wall bottom, said wall top and wall bottom extending to said annular shape forming a plurality of hollow cavities, and said member further comprising a plurality of flanges depending from said annular shape where said flanges are spaced apart by a beam wherein, said beam is generally perpendicular to said flanges.

7. In the edging member of claim 6, said chamber wall is contiguous with said annular shape.

8. In the edging member of claim 6, said chamber wall further comprises a top section, a bottom section, and a center section such that said top section and said bottom section are thicker in makeup then said center section.

9. In the edging member of claim 6, said flanges numbering two.

10. In the edging member of claim 6, said member being manufactured of a high density resin.

11. A seating device comprising a frame and a resilient edging member secured thereon, said edging member comprising a substantially annular shape defined by at least one interior chamber wall having a wall top and a wall bottom, said wall top and wall bottom extending to said annular shape forming a plurality of hollow cavities, and said member further comprising a plurality of flanges depending from said annular shape where said flanges are engagable with said frame and are spaced apart by a beam wherein, said beam is generally perpendicular to said flanges.

12. In the seating device of claim 11, said chamber wall is contiguous with said annular shape.

13. In the seating device of claim 11, said chamber wall further comprises a top section, a bottom section, and a center section such that said top section and said bottom section are thicker in makeup then said center section.

14. In the seating device of claim 11, said flanges numbering two.

15. In the seating device of claim 11, said member being manufactured of a high density resin.

16. In the seating device of claim 11, said beam comprises a geometric shape which conforms to the shape of said frame resulting in a substantial flush fit.

17. In the seating device of claim 11, said device further comprising upholstery secured to said flanges by means hidden by said upholstery.

* * * * *